US008272909B2

(12) United States Patent
Hoffman

(10) Patent No.: US 8,272,909 B2
(45) Date of Patent: Sep. 25, 2012

(54) METHOD OF ASSEMBLING A SMALL-DIAMETER SPARK PLUG WITH RESISTIVE SEAL

(75) Inventor: John W. Hoffman, Perrysburg, OH (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 13/211,539

(22) Filed: Aug. 17, 2011

(65) Prior Publication Data

US 2011/0298164 A1 Dec. 8, 2011

(51) Int. Cl.
*H01T 21/02* (2006.01)
*H01T 21/00* (2006.01)

(52) U.S. Cl. ..... 445/7

(58) Field of Classification Search ..... 445/7; 264/614, 264/616, 618, 620
See application file for complete search history.

(56) References Cited

U.S. PATENT DOCUMENTS

| | | | |
|---|---|---|---|
| 2,071,571 | A | 2/1937 | Rabezzana et al. |
| 2,106,578 | A | 1/1938 | Schwartzwalder et al. |
| 2,296,033 | A | 9/1942 | Heller |
| 2,342,842 | A | 2/1944 | Corbin et al. |
| 2,597,978 | A | 5/1952 | Doran |
| 2,604,087 | A | 7/1952 | Gregory et al. |
| 2,829,063 | A | 4/1958 | Schwartzwalder et al. |
| 2,837,679 | A | 6/1958 | Schwartzwalder et al. |
| 2,840,628 | A | 6/1958 | Candelise et al. |
| 2,871,389 | A | 1/1959 | Skunda |
| 2,874,323 | A | 2/1959 | Bychinsky et al. |
| 2,902,617 | A | 9/1959 | Cole |
| 2,906,909 | A | 9/1959 | Sommers et al. |
| 2,977,498 | A | 3/1961 | Bychinsky |
| 3,256,457 | A | 6/1966 | Bretsch |
| 3,320,461 | A | 5/1967 | Feins |
| 3,468,004 | A | 9/1969 | Bretsch |
| 3,538,021 | A | 11/1970 | Achey |
| 3,548,239 | A | 12/1970 | Eaton |

(Continued)

FOREIGN PATENT DOCUMENTS

EP 171153 A * 2/1986

(Continued)

OTHER PUBLICATIONS

"Pernifer 36—alloy 36," Material Data Sheet No. 7001, Mar. 2004 Ed., 12 pages.

(Continued)

*Primary Examiner* — Mariceli Santiago
(74) *Attorney, Agent, or Firm* — Robert Stearns; Dickinson Wright PLLC

(57) ABSTRACT

A spark plug (10) includes an intermediate connecting pin (54) disposed in the central passage (28) of an the insulator body (12). The connecting pin (54) seats in an intermediate taper section (72) within the central passage (28), which is generally frustoconical and establishes a transition between a first larger diameter of the central passage (28) and a second smaller diameter. The intermediate tapered section (72) is located longitudinally above a filleted transition (26) feature of the insulator body (12) exterior. A pin head (53) of the connecting pin (54) has a complementary tapered under-cut and seats against the intermediate tapered section (72) to provide self-centering of the connecting pin (54) without trapping gas during the assembly process. The intermediate taper section (72) also provides an increase in insulator wall thickness which improves dielectric capacity and structural integrity of the insulator (12).

6 Claims, 7 Drawing Sheets

U.S. PATENT DOCUMENTS

| | | | | |
|---|---|---|---|---|
| 3,909,459 | A | 9/1975 | Friese et al. | |
| 3,915,721 | A | 10/1975 | Kamigaito et al. | |
| 3,967,230 | A | 6/1976 | Kamigaito et al. | |
| 4,059,782 | A | 11/1977 | Lentz | |
| 4,388,549 | A | 6/1983 | Bensman | |
| 4,439,708 | A | 3/1984 | Hattori et al. | |
| 4,460,847 | A | 7/1984 | Englehardt | |
| 5,463,267 | A | 10/1995 | Conway | |
| 5,760,533 | A | 6/1998 | Saiki et al. | |
| 5,952,770 | A | 9/1999 | Mueller et al. | |
| 6,160,342 | A | 12/2000 | Nishikawa et al. | |
| 6,191,525 | B1 | 2/2001 | Tanaka et al. | |
| 6,328,619 | B1 * | 12/2001 | Shimizu et al. | 445/7 |
| 6,380,664 | B1 | 4/2002 | Pollner | |
| 6,489,709 | B1 | 12/2002 | Teramura et al. | |
| 6,580,202 | B1 | 6/2003 | Pollner | |
| 6,806,628 | B2 | 10/2004 | Suzuki | |
| 6,888,293 | B2 | 5/2005 | Roessler et al. | |
| 7,059,926 | B2 | 6/2006 | McMurray et al. | |
| 7,449,823 | B2 | 11/2008 | Menken et al. | |
| 8,092,269 | B2 * | 1/2012 | Shibata et al. | 445/7 |
| 2002/0074919 | A1 | 6/2002 | Labarge et al. | |
| 2005/0093414 | A1 | 5/2005 | Downs et al. | |
| 2005/0110382 | A1 | 5/2005 | Walker, Jr. | |
| 2007/0132354 | A1 | 6/2007 | Scott et al. | |
| 2007/0290590 | A1 | 12/2007 | Hoffman | |
| 2007/0290594 | A1 | 12/2007 | Hoffman et al. | |

FOREIGN PATENT DOCUMENTS

| | | | |
|---|---|---|---|
| JP | 54158541 | A * | 12/1979 |
| JP | 1997-219273 | A | 8/1997 |
| JP | 2010135345 | A * | 6/2010 |

OTHER PUBLICATIONS

"Pernifer 2918," Material Data Sheet No. 7002, Sep. 2004 Ed., 10 pages.
"Pernifer and Pernima Alloys," Aug. 2006 Ed., 36 pages.

* cited by examiner

METHOD OF ASSEMBLING A SMALL-DIAMETER SPARK PLUG WITH RESISTIVE SEAL

CROSS REFERENCE TO RELATED APPLICATIONS

The present application claims priority to U.S. provisional application having Ser. No. 60/938,516, filed on May 17, 2007 and U.S. Ser. No. 12/121,821, filed on May 1, 2008.

BACKGROUND OF THE INVENTION

1. Field of the Invention

The subject invention relates to a spark plug fora spark-ignited internal combustion engine, and more particularly toward a spark plug having a fired-in suppressor seal contained in the insulator between a lower center electrode and an intermediate connecting pin.

2. Related Art

A spark plug is a device that extends into the combustion chamber of an internal combustion engine and produces a spark to ignite a mixture of air and fuel. In operation, charges of up to about 40,000 volts are applied through the spark plug center electrode, thereby causing a spark to jump the gap between the center electrode and an opposing ground electrode.

Electromagnetic interference (EMI), also known as radio frequency interference (RFI), is generated at the time of the electrical discharge across the spark gap. This is caused by the very short period of high frequency, high current oscillations at the initial break down of the gap and at points of refirings. This EMI (or RFI) can interfere with entertainment radio, two-way radio, television, digital data transmissions or any type of electronic communication. In a radio for example, the EMI or RFI is usually noticed as a "popping" noise in the audio that occurs each time the spark plug fires. Ignition EMI is a nuisance and in extreme cases can produce performance and safety related malfunctions.

Levels of EMI emitted by a spark ignition system engine can be controlled or suppressed in many ways. Commonly, EMI suppression of the ignition system itself is accomplished by various methods, including the use of resistive spark plugs, resistive ignition leads, and inductive components in a secondary high voltage ignition circuit. A common type of resistor/suppressor spark plug used for the suppression of EMI contains an internal resistor element placed within the ceramic insulator between the upper terminal stud and the lower center electrode.

While internal resistor/suppressor spark plug designs are well known, practical considerations have frustrated the ability to integrate a resistor in small diameter spark plugs, for example those sized to fit a 12 mm or less (10 mm, 8 mm, etc.) diameter threaded bore. In particular, the fairly large cross-sectional area required for the resistor inside the insulator weakens the structural integrity of the ceramic insulation by creating a thin wall section precisely in the region of an insulator which is often highly stressed during assembly and operation. Also, by creating such a thin wall, the amount of voltage the part can sustain is reduced. Furthermore, reducing the cross-sectional area of the resistor demands a corresponding reduction in the diameter of the upper terminal stud which is used for the cold pressing and tamping operations. Thus, during the cold pressing operation where loose, granular resistor material is compressed by the upper terminal stud, and then later hot pressed to produce the so-called "fired in suppressor seal" buckling of a reduced diameter upper terminal stud is possible, both during initial insertion into the unfired powder, and during the hot pressing operation.

Additionally, the relatively long, unitary upper terminal studs are typically heated along with the sealing glasses in a furnace prior to the hot pressing operation. Heating of the upper terminal stud results in oxidation and discoloration of the terminal. In addition to detracting from the aesthetic appearance of the exposed terminal stud, the oxidized terminal (post heating) presents a rougher surface finish that requires more force to connect a spark plug wire lead.

FIG. 1 represents an example of a prior art spark plug construction taken from the Applicant's own U.S. Publication No. 2005/0093414, published May 5, 2005, the entire disclosure of which is hereby incorporated by reference. This publication illustrates use of an intermediate connecting pin lodged in the central passage of the insulator, generally midway between a center electrode at the lower end of the insulator and a terminal post at the upper end of the insulator. The contact pin fits snugly within the central passage and includes a threaded lower portion, which is embedded in the conductive glass seal above the center electrode. As described in Paragraph [0021] of that publication, the glass seal may have several distinctive layers to provide desirable electrical characteristics such as suppression of high frequency interference. While this design represents a marked improvement over then-existing prior art instructions, there remain certain shortcomings. For example, the smooth piston-like fit of the connecting pin within the central passage has the potential to trap gasses during assembly, thereby creating gas bubble inclusions within the glass seal which degrade electrical performance during use. This may also cause stress that could burst the side walls of the ceramic insulator under pressure. Furthermore, in high thermal cycling events over prolonged use, it is possible that the connection between the threaded lower portion of the connecting pin and the enveloping glass seal may break loose due to differing rates of thermal expansion and the thermal stresses that result during cycling.

FIG. 2 represents another prior art design such as that depicted in U.S. Pat. No. 3,915,721, issued Oct. 28, 1975. In this example, a connecting pin having a lateral dimension substantially smaller than the internal diameter of the central passage is provided. Due to the sizeable clearance space between the connecting pin and the side walls of the central passage, there is no chance for gasses to become trapped during the assembly process. However, a design of the type depicted in FIG. 2 presents certain difficulties of its own. For one example, the clearance space affords an opportunity for the connecting pin to tip or become uncentered during assembly, as shown by broken lines in FIG. 2. Loss of control of the position of the pin during processing can result in unacceptable variations in the resistance of the finished spark plug.

Another shortcoming exhibited by both prior art designs depicted in FIGS. 1 and 2 relates to the unique challenges confronted when attempting to downscale the size of the spark plug. These issues are mentioned above and include a thinning of the insulator wall in critical areas, such that the dielectric capacity of the insulator material may be breached. For illustrative purposes, a dielectric puncture zone is depicted in FIG. 2. Furthermore, these thinned sections of insulator wall become failure points when, during assembly, the shell is clamped about the exterior of the insulator, thereby placing a region of the insulator in compression. Thin sections of the insulator wall are thus susceptible to catastrophic failure during compression loading. The prior art designs depicted in FIGS. 1 and 2 are fairly typical, and illustrate the central passage as having a continuous interior diameter from the upper terminal end of the insulator to the head of the center electrode. Thus, as the spark plug is scaled down to accommodate smaller sized applications, the proportional decrease in wall thickness of the insulator can result in dielectric breach and/or compression load failure.

Accordingly, the current trend toward reduced diameter spark plugs introduces many practical difficulties. The insulator wall thickness area of fired-in suppressor seal components experiences weakened structural integrity. Furthermore, the current technique of heating the upper terminal stud together with the sealing glasses in a furnace results in oxidation and discoloration of the upper terminal stud which detracts aesthetically and contributes to connector installation problems. Therefore, there is a need in this field to provide a spark plug assembly that can implement the well known fired-in suppressor seal features in a small diameter package, and which further avoids problems associated with heating the upper terminal stud in a furnace.

SUMMARY OF THE INVENTION

The subject invention is a spark plug assembly for a spark-ignited combustion event. The assembly comprises a generally tubular insulator having an upper terminal and a lower nose end. A central passage extends longitudinally between the terminal and nose ends of the insulator. A conductive shell surrounds at least a portion of the insulator. The shell includes at least one ground electrode proximate the nose end of the insulator. A center electrode is disposed in the central passage of the insulator, with a lower sparking end exposed through the nose end and presented in opposing relation to the ground electrode so as to establish a spark gap in the space therebetween. The center electrode further includes an electrode head seated in the central passage. An intermediate connecting pin is disposed in the central passage and has a shank spaced from the electrode head of the center electrode. A fired-in suppressor seal electrically interconnects the electrode head and the shank of the connecting pin within the central passage. The central passage includes an intermediate tapered section generally midway between the terminal end and the electrode head, and the connecting pin has a tapered pin head that is seated in the tapered section of the central passageway.

The invention overcomes the shortcomings and disadvantages of the prior art designs due to the intermediate tapered section of the central passage, which advantageously self-centers the connecting pin within the central passage in such a manner an as to avoid pressure build-up during assembly. Furthermore, the intermediate tapered section creates an increase in insulator wall thickness, thus providing increased dielectric capacity and greater column strength in the body of the insulator within compression and dielectric puncture zone regions.

The invention also contemplates a method for assembling a spark plug comprising the steps of: providing a generally tubular insulator having an upper terminal end and a lower nose end with a central passage extending longitudinally between the terminal and nose ends. A center electrode is inserted into the central passage of the insulator such that a lower sparking end of the center electrode is exposed through the nose end. The center electrode includes an electrode head seated in the central passage. The central passage is then filled with loose granular or pelletized sealing materials. The method further includes compressing the loose sealing materials against the electrode head. Following this, an intermediate connecting pin is inserted into the central passage, the connecting pin having a lower shank portion, along with (potentially—if not on press head) a removable push rod. This assembly is then heated (the insulator, center electrode, connecting pin, and loose sealing materials) to a temperature at which the loose sealing materials become fluidic and begin to coalesce. The assembly is then removed from the furnace, and the connecting pin compressed so as to densify the coalescing sealing materials. A tapered head of the connecting pin is held against an intermediate tapered section in the central passage, generally midway between the terminal end and the electrode head, while the sealing materials solidify into an elastic solid. In this manner, a spark plug is assembled which overcomes the disadvantages and shortcomings of the prior art in the manner described above.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
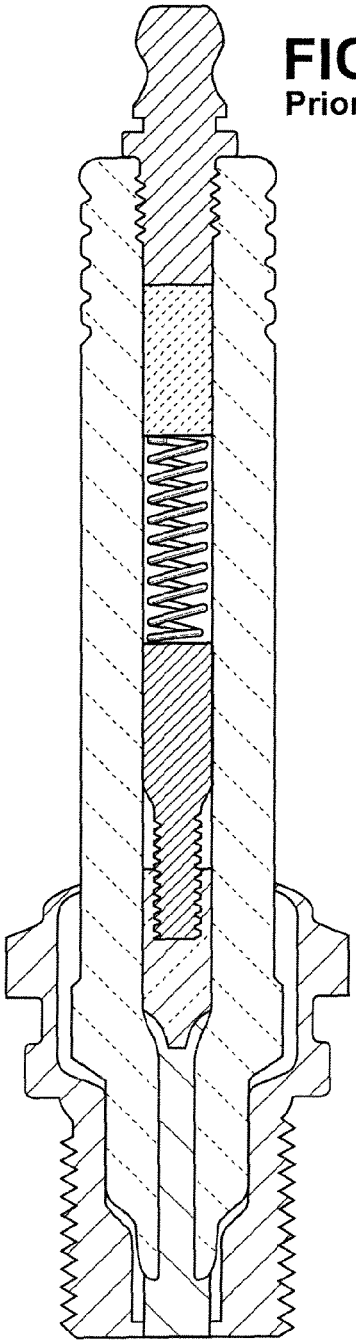
FIG - 1 Prior Art
FIGS. 1 and 2 depict alternative prior art spark plug designs.
Figure 2:
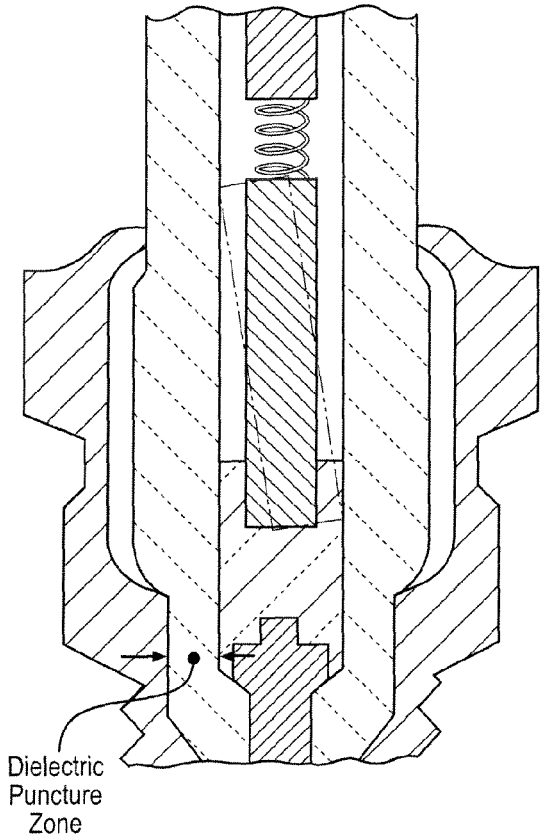
FIG - 2 Prior Art
Figure 3:
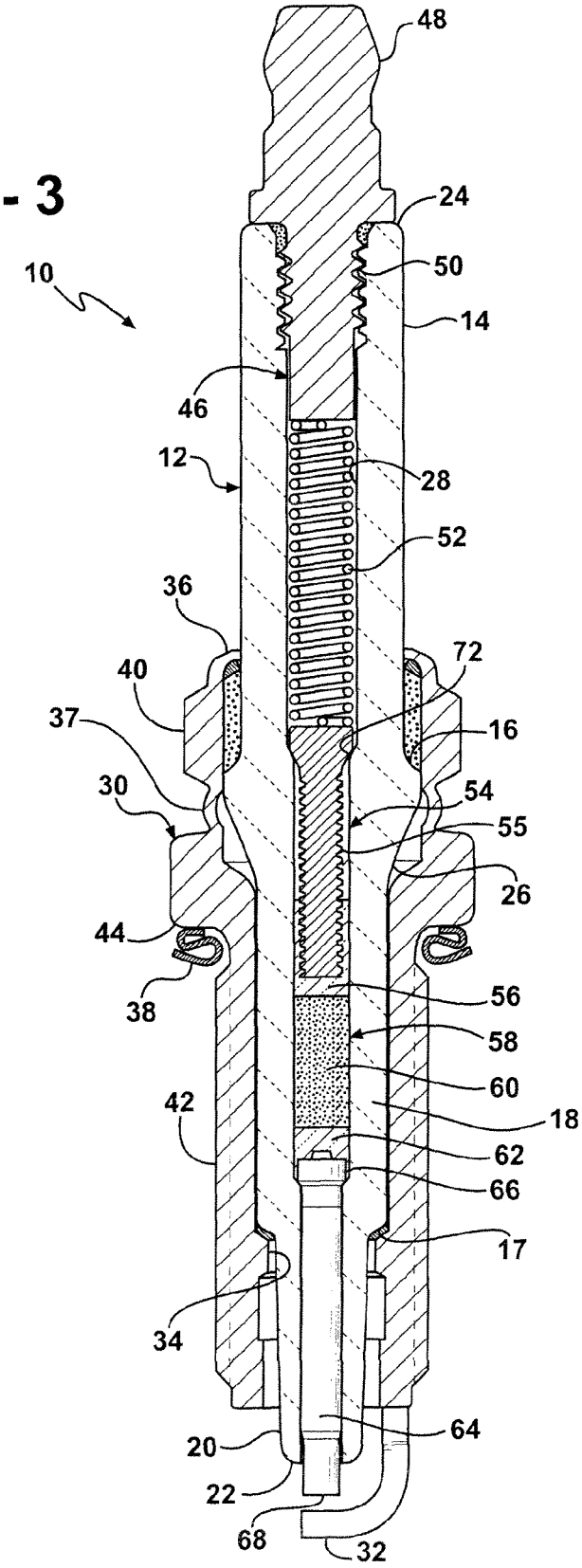
FIG. 3 is a cross-sectional view of a spark plug assembly incorporating a fired-in suppressor seal between a connecting pin and the lower center electrode according to the subject invention.
Figure 4:
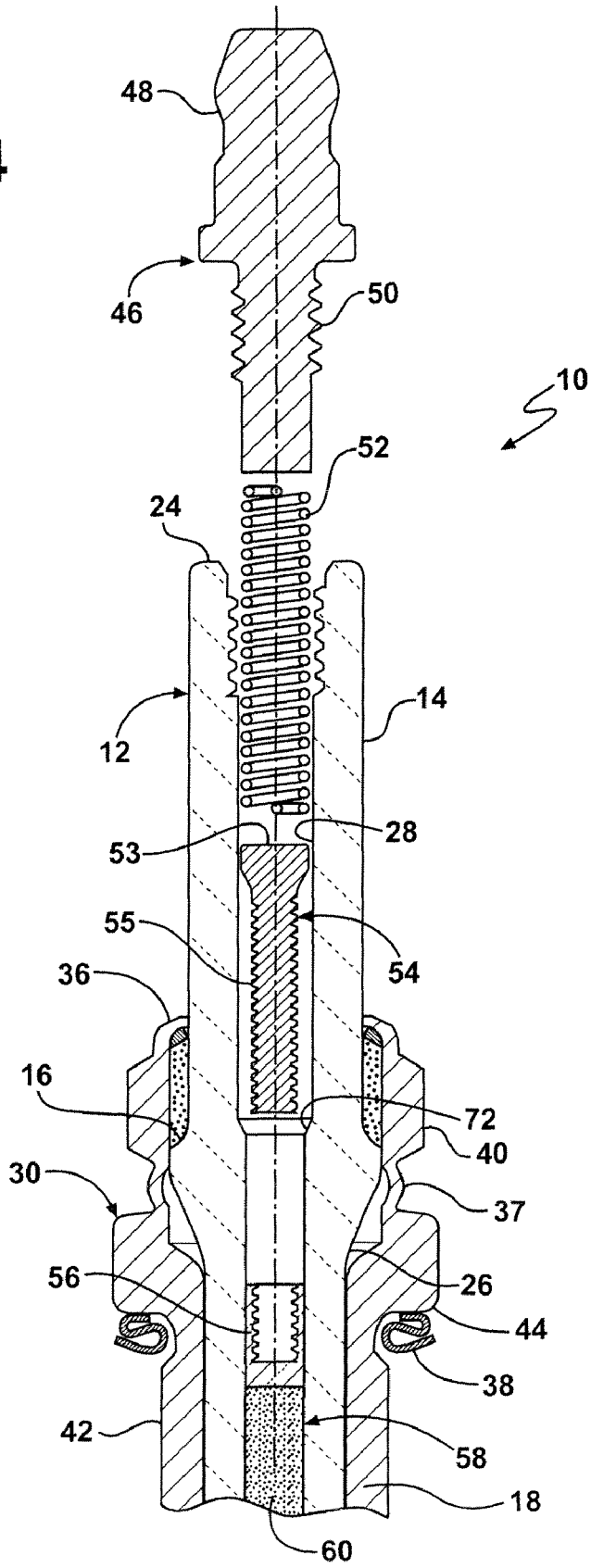
FIG. 4 is an enlarged, partially exploded view of the spark plug assembly of FIG. 3.

Referring to the Figures, wherein like numerals indicate like or corresponding parts throughout the several views, a spark plug according to the subject invention is generally shown at 10 in FIG. 3. The spark plug 10 includes a tubular ceramic insulator, generally indicated at 12, which may be made from an aluminum oxide ceramic or other suitable material having the desired dielectric strength, mechanical strength and resistance to heat shock. The insulator 12 may be molded dry under extreme pressure and then kiln-fired to vitrification at high temperature. However, those skilled in this art will appreciate that methods other than dry pressing and sintering may be used to fowl the insulator 12. The insulator 12 has an outer surface which may or may not be glazed about its exposed portions. The insulator 12 may include a partially exposed upper mast portion 14 to which a rubber spark boot (not shown) surrounds and grips to establish a connection with the ignition system. The exposed mast portion 14 is shown in FIG. 3 as a generally smooth surface, but may include the more traditional ribs for the purpose of providing added protection against spark or secondary voltage "flash-over" and to better improve grip with the rubber spark plug boot Immediately below the mast portion 14, is a large upper shoulder 16 from which the cross-sectional diameter of the insulator 12 expands to its maximum width. Further down the insulator 12, a small lower shoulder region 18 reduces the insulator outer diameter to a lower seat 17, which progressively narrows toward a tapering nose section 20. A nose end 22 establishes the bottom most portion of the insulator 12, whereas a terminal end 24 establishes the extreme opposite, uppermost end of the insulator 12, formed at the top of the mast portion 14. A filleted transition 26 is an exterior surface feature of the insulator 12, formed between the large upper shoulder 16 and the small lower shoulder region 18. The filleted transition 26 provides a smooth change from the greater insulator diameter at the large shoulder 16 to the lesser diameter in the small shoulder region 18.

Figure 5:
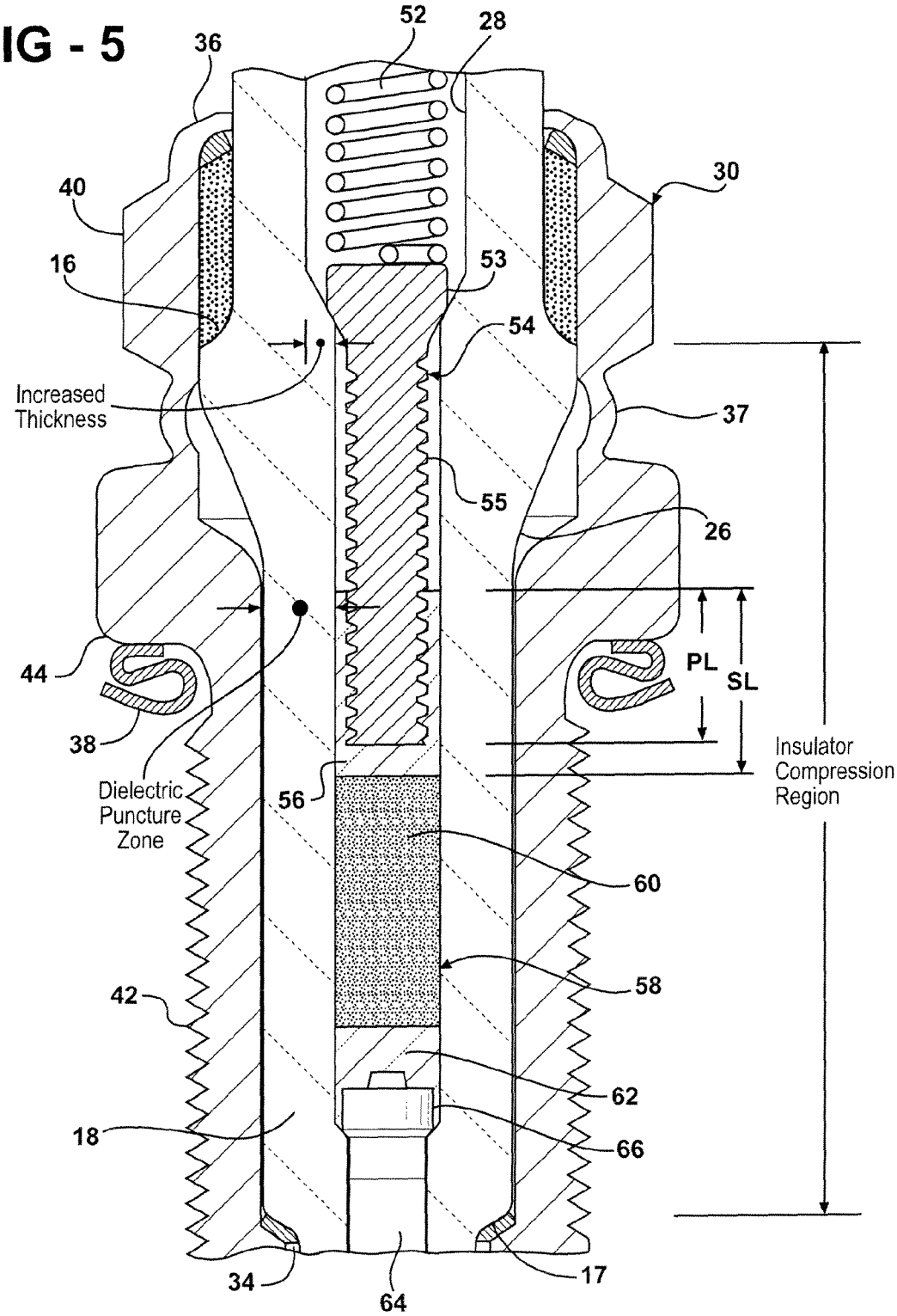
FIG. 5 is an enlarged, fragmentary view of the fired-in suppressor seal (FISS) region of the insulator with various dimensional relationships called out.

The insulator 12 is of generally tubular construction, including a central passage 28 extending longitudinally between the terminal end 24 at the top of the insulator 12 and the lower nose end 22. The central passage 28 is of varying cross-section area, generally greatest at or adjacent the terminal end 24 and smallest at or adjacent the nose end 22. As will be described in greater detail subsequently, the central passage 28 includes an intermediate tapered section 72 generally midway between the terminal end 24 and a head 66 of a center electrode. Preferably, the tapered section is located at a longitudinal position above the filleted transition 26. In the example shown, the tapered section 72 is located just above the large upper shoulder 16, thereby providing maximum wall thickness for the insulator 12 throughout the insulator compression region (as shown in FIG. 5). The tapered section 72 is generally frustoconical, and establishes a transition between a first larger diameter of the central passage 28 and a second smaller diameter.

A conductive, preferably metallic shell is generally indicated at 30. The shell 30 surrounds the lower regions of the insulator 12 and includes at least one ground electrode 32. While the ground electrode 32 is depicted in FIG. 3 in the traditional single J-shaped style, it will be appreciated that an alternatively shaped single electrode, multiple ground electrodes, or an annular ground electrode, or any other known configuration can be substituted depending upon the intended application of the spark plug 10. Indeed, as spark plug diameters reduce, the so-called "no (zero) ground" electrodes become an acceptable construction alternative.

The shell 30 includes an internal lower compression flange 34 adapted to bear in pressing contact against the lower seat 17 of the insulator 12. The shell 30 further includes an upper compression flange 36 which is crimped or deformed over during the assembly operation to bear in pressing contact against the large shoulder 16 of the insulator 12. A buckle zone 37 yields under the influence of an overwhelming compressive force during or subsequent to the deformation of the upper compression flange 36 to hold the shell 30 in a fixed position with respect to the insulator 12. Gaskets, cement or other sealing compounds can be interposed between the insulator 12 and the shell 30 at the points of engagement to perfect a gas tight seal and improve the structural integrity of the assembled spark plug 10. Accordingly, after assembly, the shell 30 is held in tension between the upper 36 and lower 34 compression flanges, whereas the insulator 12 is held in compression between the large shoulder 16 and the lower seat 17. The compression region is called out in FIG. 5. This results in a secure, gas tight, permanent fixation between the insulator 12 and the shell 30.

The shell 30 further includes a tool receiving fitting 40 for removal and installation purposes. The fitting 40 may be in the shape of a hex, sized to comply with industry standards for the intended application. Of course, other fitting 40 shapes may also be used (12 point hex, spline, thread, etc). A threaded section 42 is formed at the lower portion of the metallic shell 30, immediately below a seat 44. Of course, other fastening arrangements may also be used instead of threads 42 (spline, no thread, etc.) as needed to engage the engine. The seat 44 may be provided with a gasket 38 to provide a suitable interface against which the spark plug seats in the cylinder head. Alternatively, the seat 44 may be formed with a simple or complex taper or a flat or other features (not shown) to provide a close tolerance installation in a cylinder head which is designed for this type of spark plug.

A conductive terminal stud 46 is partially disposed in the central passage 28 of the insulator 12 and extends longitudinally from the exposed top post 48 a relatively short distance into the central passage 28. Threads 50 are formed on the lower shank portion of the stud 46 and engage a corresponding female thread formed inside the central passage 28 of the insulator 12. The top post 48 connects to an ignition wire (not shown) and receives timed discharges of high voltage electricity required to fire the spark plug 10.

Figure 6:
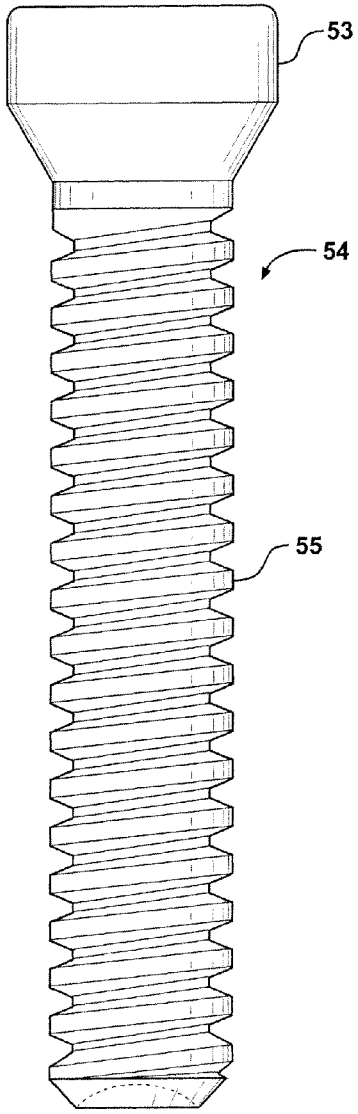
FIG. 6 is a detailed drawing of the connecting pin according to the subject invention.

The bottom end of the terminal stud 46 abuts against a compression spring 52 which is formed of an electrically conductive material. The compression spring 52 seats at its lower most end against the head 53 of a connecting pin, generally indicated at 54. An enlarged view of the connecting pin 54 is shown in FIG. 6. The connecting pin 54 includes a lower shank portion 55 embedded within a conductive glass seal 56, which forms the top layer of a fired-in suppressor seal or assembly, generally indicated at 58. The shank 55 may be threaded, knurled, or otherwise disturbed to better anchor itself in the seal 58. In the case of a helical thread form acting as the disturbance feature, the thread size does play a role in the bedding process. Preferably, the major diameter of the threads, minus the minor diameter of the threads, divided by 2, is greater than or equal to 0.004." To ensure adequate clearance for glass flow during hot pressing, a small radial clearance is provided between the shank 55 and the second smaller diameter of the central passage 28. For example, the minimum nominal radial clearance might be on the order of 0.004" as measured from the thread to the bore. This clearance permits the glass to flow back around the pin 54, and thus secure it in the glass seal 56. Too small of a nominal clearance may impair manufacturability by not allowing the glass 56 to back flow, or perhaps creating an excessive hydraulic pressure during assembly.

On the other hand, too large a clearance will not sufficiently compact the glass 56, thereby shortening life span and degrading resistor functionality. The embedded or potted length (PL) of the shank 55 is also critical. As per the relationships noted on FIG. 5, this embedded length (PL) should be at least 70% of the designed length (SL) of the upper glass seal 56 and preferably not more than , at most, 100% of the designed length (SL) of the seal 56. This ensures adequate fired-in suppressor seal 58 compaction during hot pressing while minimizing the potential for glass 56 to flow into the upper bore (i.e., above the intermediate taper section 72) and impair electrical function. The taper angle under the pin head 53 should closely match the taper angle of intermediate taper section 72, perhaps within +/−3 degrees, to ensure good seating and centering of the connecting pin 54. Radial clearance between the head 53 of the connecting pin 54 and the insulator bore 28 (i.e., at the first larger diameter) should also be at least 0.003" to ensure that it does not bind during hot pressing or trap gas. The distal end of the shank 55 may be flat, cupped, or otherwise contoured so as to retain glass 56 and/or promote glass 56 flow during the hot-pressing operation.

The conductive glass seal 56 functions to seal the bottom end of the connecting pin 54 within the central passage 28, while conducting electricity to a resistor layer 60. This resistor layer 60, which in the embodiment depicted in the drawings, comprises the central layer of a three-tier fired-in suppressor seal 58. Such a fired-in suppressor seal 58 can be made from any suitable composition known to reduce electromagnetic interference (EMI). However, single layer and other forms of multi-layer fired-in suppressor seals could be used in appropriate applications. The illustrated fired-in suppressor seal 58 includes glass, fillers and carbon/carbonaceous materials in such ratios to ensure appropriate resistance when pressed and provide a stable resistance over the anticipated service life. Immediately below the resistor layer 60, another conductive glass seal 62 establishes the bottom, or lower layer of the fired-in suppressor seal 58. The conductive glass can be made from a mixture of glass and copper metal powder at approximately 1:1 ratio by mass, as is well known in the industry. Accordingly, electricity travels from the terminal stud 46 through the compression spring 52 and into the connecting pin 54, then through the top layer of conductive glass 56, through the resistor layer 60 and into the lower conductive glass seal layer 62.

A conductive center electrode 64 is partially disposed in the central passage 28 and extends longitudinally between an electrode head 66 encased in the lower glass seal layer 62 to an exposed sparking tip 68 proximate the ground electrode 32. Thus, the electrode head 66 of the center electrode 64 is longitudinally spaced from the bottom end of the connecting pin 54, within the central passage 28. The fired-in suppressor seal 58 electrically interconnects the connecting pin 54 and the center electrode 64, while simultaneously sealing the central passage 28 from combustion gas leakage and also suppressing radio frequency noise emissions from the spark plug 10.

As shown, the center electrode 60 is preferably a one-piece, unitary structure extending continuously and uninterrupted between its electrode head 66 embedded in the glass seal 62 and its sparking tip 68 in the gap opposite the ground electrode 32. The center electrode 60 may be made from a nickel alloy with or without a copper core. Although the specific material selection is beyond the scope of this invention, as well as the specific design of the center electrode.

Figure 7A:
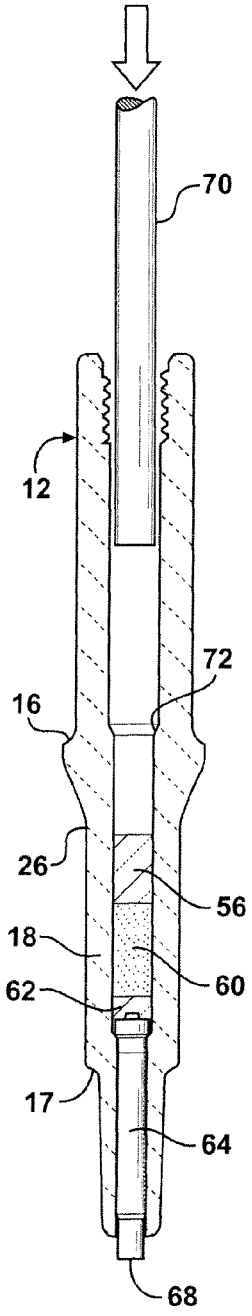
FIGS. 7A-D represent a sequence of assembly steps depicting the formation of a spark plug according to this invention.
Figure 7B:
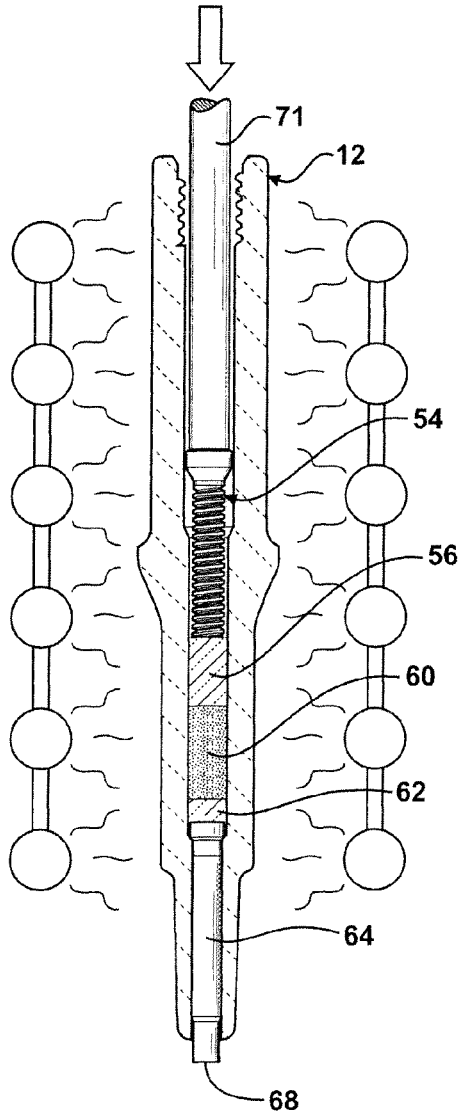

Referring now to FIGS. 7A-D, a preferred method for installing the suppressor seal 58 within the central passage 28 is illustrated schematically. According to the preferred embodiment of this invention, the suppressor seal 58 is of the fired-in type, wherein each of the layers 56, 60, 62 are separately laid down in a filling operation. Typically, each layer 56, 60, 62 will be separately loaded and then tamped with a solid tamper 70 to a preferred compaction pressure, which, for example, may be on the order of 20 kpsi or more. However, some of the layers might be loaded without tamping. FIG. 7A depicts the final tamping operation. Alternatively, instead of granular materials, preformed tablets may be used. Furthermore, other seal constructions having more or fewer layers and various electrical qualities may be preferred in some applications.

Figure 7C:
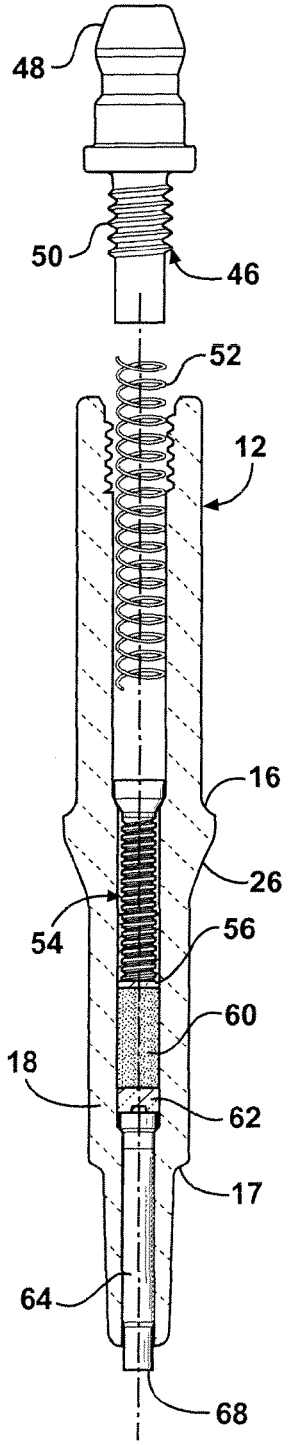
Figure 7D:
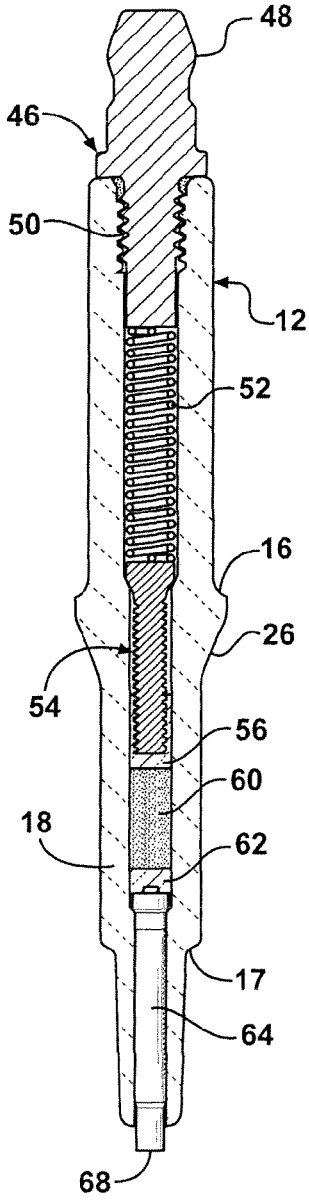

Once these granular materials (or preformed tablets) have been loaded into the central passage 28, the connecting pin 54 is loaded while the subassembly is heated to a temperature at which the granular materials 56, 60, 62 soften and fuse, i.e., coalesce and congeal. See FIG. 7B. The heated assembly is withdrawn from the furnace, and the connecting pin 54 is forced toward a fully seated position using a removable push rod 71 where the tapered underside of its head seats in a corresponding intermediate taper section 72 in the central passage 28 as best shown in FIGS. 7C and 7D. Of course, a push rod that is fused to the press head could be used in lieu of a removable push rod 71.

When the pin head 53 of the connecting pin 54 is seated against the intermediate taper section 72, the central passage 28 is closed and sealed. During this operation, the softened material of the lower conductive glass seal layer 62 flows around the head 66 of the center electrode 64, and seals the central passage 28 in the region of the center electrode head 66 as it congeals, i.e., solidifies into an elastic solid. Likewise, the shank 55 of the connecting pin 54 becomes embedded in the top layer of the conductive glass seal 56, thereby fixing it in position while simultaneously sealing the central passage 28 from combustion gas leakage. By this method, the fired-in suppressor seal 58 can be formed of the fired-in type which is robust, economical and effective in terms of suppressing radio frequency noise emissions and sealing the central passage 28 from combustion gas leakage.

Figure 8:
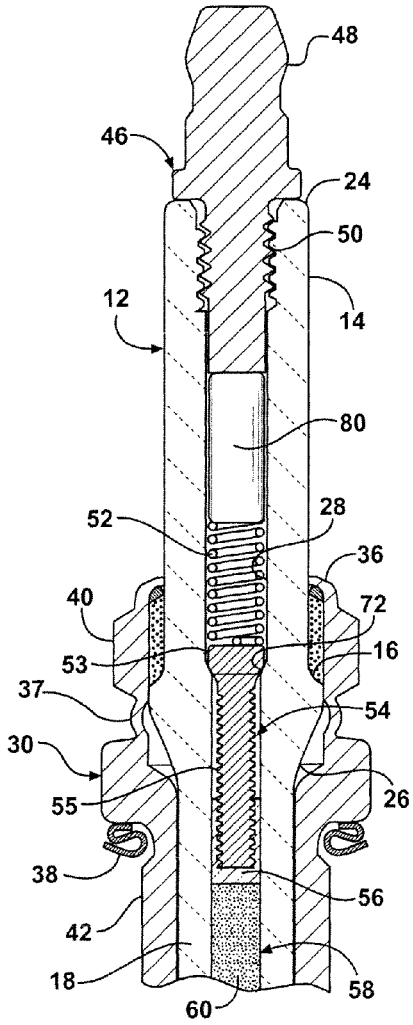
FIG. 8 is an enlarged cross-sectional view of an alternative embodiment of this invention, wherein a supplemental electronic capsule is installed below the terminal stud.

Although the invention described above includes a take-up compression spring 52 to occupy the open space between the connecting pin 54 and the terminal stud 46, other options may be preferred. For example, the space may be filled with one or more electrically active elements (resistors, inductors, capacitors, or discrete circuitry) in order to provide enhanced functionality and continuity between connecting pin 54 and the terminal stud 46. In fact, a unique aspect of the subject invention enables the space to be utilized by a capsule resistor, capacitor, inductor or other discrete electrical component 80 that further enhance functionality of the spark plug 10 as depicted in FIG. 8. In other words, the compression spring 54 can be eliminated or shortened to enable additional functional components 80 to be interposed between the terminal stud 46 and the connecting pin 54. Components 80 can be mixed and matched to achieve the desired functionality. This functionality may prove particularly valuable during suppression of RFI (EMI), as components 80 such as suppressors in the fired-in suppressor seal 58 and inductors may be combined to provide needed RFI suppression with minimal resistance.

The subject invention proposes a unique variation of the fired-in suppressor seal 58 currently used in automotive and small engine spark plugs. Prior art suppressor seal type spark plugs are made by pressing a unitary terminal into a mass of molten glass to form the seal. However, the subject invention replaces the long, unitary terminal with a small, isolated connecting pin 54. This connecting pin 54 is placed in the proximal end of the fired-in suppressor seal 58 during the glass seal hot press operation (FIG. 7A). A discrete push rod 71 is used to allow the connecting pin 54 to be pressed in during firing. The subject invention and its assembly method eliminates the need for the long, unitary terminal stud of the prior art, thereby overcoming the mechanical, esthetic and oxidation issues in the prior art designs.

The connecting pin 54 may be fabricated from a nickel-plated steel alloy as per common construction for fired-in suppressor seal type terminals. An improvement on this design, however, would involve the use of solid nickel or nickel alloys in place of the steel, and without plating, thus avoiding the plating step. Additional improvements in the connecting pin 54 might be achieved by using a low-expansion alloy of the type commonly used in glass-to-metal sealing, where the alloy would be characterized as having a coefficient of thermal expansion less than or equal to that of the solidified fired-in suppressor seal 58 and/or the ceramic insulator body. That is, less than or equal to 8.5 ppm/° C. over the range of room temperature to 400° C. The steel terminals typically employed in prior art constructions have thermal expansion rates much higher than that of the insulators and the glass sealing materials, e.g., on the order of >10 ppm/° C. In the prior art, this results in significant thermal stresses on the fired-in suppressor seal 58 during cooling and after fabrication. The stresses can lead to mechanical failure affecting the integrity of the hermetic seal and terminal retention. However, the use of an alloy of lower expansion will greatly reduce the stresses, resulting in a more robust seal. Such alloys are typically difficult to form, however, and therefore have not been used in terminal stud applications until now. The subject invention which utilizes the connecting pin 54 could be formed from these more preferred, thermally compatible alloys, since the connecting pin 54 is small and its formation would be far less difficult than is encountered with prior art designs.

Furthermore, low-expansion alloys are more expensive than nickel, nickel alloy, and plated steel products. This invention design minimizes the use of low-expansion alloys to only that amount needed to make contact with the seal. Also, this concept eliminates the expense of the nickel plating operation on the stud of a traditional connecting pin. Examples of low (coefficient of thermal) expansion alloys include: Pernifer 2918, Pernifer 36 alloy 36, and other Pernifer alloys, all available commercially from ThyssenKrupp VDM, of Werdohl, Germany.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A method of assembling a spark plug comprising the steps of:

providing a generally tubular insulator having an upper terminal end and a lower nose end, and a central passage extending longitudinally between the terminal and nose ends;

inserting a center electrode into the central passage of the insulator such that a lower sparking end of the center electrode is exposed through the nose end, the center electrode further including an electrode head seated in the central passage;

filling the central passage with loose granular or pelletized sealing materials;

compressing the loose sealing materials against the electrode head;

heating the insulator, center electrode and loose sealing materials to a temperature at which the loose sealing materials become fluidic and begin to coalesce;

inserting an intermediate connecting pin into the central passage, the connecting pin having a lower shank portion;

displacing the coalescing sealing materials with the shank of the connecting pin;

and holding a tapered head of the connecting pin against an intermediate tapered section in the central passage, generally midway between the terminal end and the electrode head at least until the sealing materials begin to solidify into an elastic solid.

2. The method of claim 1 including surrounding at least a portion of the insulator with a conductive shell.

3. The method of claim 1 wherein said step of filling the central passage with loose granular or pelletized sealing materials includes creating alternating layers of glass and electrically resistive materials.

4. The method of claim 1 further including the step of forming a helical thread on the shank of the connecting pin.

5. The method of claim 1 further including the step of maintaining a spacing between the shank of the connecting pin and the central passage.

6. The method of claim 1 further including the step of controlling the thermal expansion of the connecting pin to be generally equal to the thermal expansion of the solidified sealing materials.

* * * * *

UNITED STATES PATENT AND TRADEMARK OFFICE

CERTIFICATE OF CORRECTION

PATENT NO. : 8,272,909 B2
APPLICATION NO. : 13/211539
DATED : September 25, 2012
INVENTOR(S) : John W. Hoffman It is certified that error appears in the above-identified patent and that said Letters Patent is hereby corrected as shown below:

Title Page, Item (63)

Bibliographic Data should be revised to include the following Related U.S. Application Data:

"Division of application No. 12/121,821, filed on May 16, 2008, now Pat. No. 8,013,502, which claims benefit of provisional application No. 60/938,516, filed May 17, 2007."

Signed and Sealed this
Thirtieth Day of June, 2015

Michelle K. Lee

Michelle K. Lee
*Director of the United States Patent and Trademark Office*